US009844719B1

(12) United States Patent
Huang

(10) Patent No.: US 9,844,719 B1
(45) Date of Patent: Dec. 19, 2017

(54) ELECTRIC SKATEBOARD WITH HINGE MECHANISM

(71) Applicant: KINPO ELECTRONICS, INC., New Taipei (TW)

(72) Inventor: Cheng-Hong Huang, New Taipei (TW)

(73) Assignee: KINPO ELECTRONICS, INC., New Taipei (TW)

( * ) Notice: Subject to any disclaimer, the term of this patent is extended or adjusted under 35 U.S.C. 154(b) by 0 days.

(21) Appl. No.: 15/590,566

(22) Filed: May 9, 2017

(30) Foreign Application Priority Data

Mar. 31, 2017 (CN) ..... 2017 2 0333555 U

(51) Int. Cl.
*A63C 17/12* (2006.01)
*A63C 17/01* (2006.01)
*A63C 17/02* (2006.01)

(52) U.S. Cl.
CPC ..... *A63C 17/12* (2013.01); *A63C 17/011* (2013.01); *A63C 17/02* (2013.01); *A63C 2203/12* (2013.01); *A63C 2203/42* (2013.01); *A63C 2203/52* (2013.01)

(58) Field of Classification Search
CPC ..... A63C 17/12; A63C 17/011; A63C 17/02; A63C 2203/12; A63C 2203/52; B60L 2200/24; B60L 2240/10; B60L 2240/12; B60L 2240/32
See application file for complete search history.

(56) References Cited

U.S. PATENT DOCUMENTS 4,861,054 A * 8/1989 Spital ..... A63C 17/015 280/11.115
5,540,455 A * 7/1996 Chambers ..... A63C 5/035 280/11.28
D633,584 S * 3/2011 Hong ..... A63C 17/12 D21/765
2010/0123295 A1* 5/2010 Landau ..... A63C 17/0046 280/87.042
2014/0326525 A1* 11/2014 Doerksen ..... A63C 17/12 180/181
2016/0114242 A1* 4/2016 Riley ..... A63C 17/012 180/233
2016/0121198 A1* 5/2016 Doerksen ..... A63C 17/01 701/22
2017/0087442 A1* 3/2017 Yang ..... A63C 17/011
2017/0144056 A1* 5/2017 Evans ..... A63C 17/015
2017/0182398 A1* 6/2017 Garcia Elena ..... A63C 17/12
2017/0203195 A1* 7/2017 Bigler ..... A63C 17/12
2017/0259163 A1* 9/2017 Zhou ..... A63C 17/12

* cited by examiner

*Primary Examiner* — Erez Gurari
(74) *Attorney, Agent, or Firm* — Chun-Ming Shih; HDLS IPR Services

(57) ABSTRACT

An electric skateboard with a hinge mechanism includes a first load plate, a second load plate, a hinge mechanism and an electric wire. A first wheel set is installed in the first load plate, and the first load plate includes a first accommodating space. A second wheel set is installed in the second load plate, and the second load plate includes a second accommodating space. A hinge mechanism includes a bridge base and two shaft sleeves pivotally connected at two sides of the bridge base. The bridge base and the two shaft sleeves together form a wiring slot. The two shaft sleeves are fixed to the first load plate and the second load plate respectively, so that the first load plate and the second load plate are foldable toward each other. The electric wire is inserted through the wiring slot.

9 Claims, 10 Drawing Sheets

ELECTRIC SKATEBOARD WITH HINGE MECHANISM

BACKGROUND OF THE INVENTION

1. Technical Field

The present invention relates to an electric skateboard structure and, in particular, to an electric skateboard with a hinge mechanism.

2. Description of Prior Art

Due to problems such as increased use of vehicles, traffic jams, air pollution, and vehicle parking, electric skateboards are becoming popular and more prevalent in the market. The electric skateboard is electrically driven, a user stands on the electric skateboard to move forward or make turns along with the skateboard.

However, a load plate of a conventional electric skateboard normally has an integral form, and the load plate is a metal board, a plastic board, or other rigid board. Therefore, when riding on a slope or on an uneven road, the load plate has difficulty in accommodating ground level variations. In addition, a skateboard made in an integral form needs more room for storage, so it is troublesome to put it away for storage or to carry it around.

In views of this, in order to solve the above disadvantage, the present inventor studied related technology and provided a reasonable and effective solution in the present disclosure.

SUMMARY OF THE INVENTION

The present invention provides an electric skateboard with a hinge mechanism. By using the hinge mechanism connected between a first load plate and a second load plate, the first load plate and the second load plate can be folded up. A first wheel set and a second wheel set are staggered in position, and an electric wire is inserted through a wiring slot of the hinge mechanism. The electric skateboard is highly adaptive to ground level variations, is collapsible for easy storage, can be carried around conveniently, can be collapsed into a small size, and can protect the electric wire and also maintain good electrical connection.

The electric skateboard with the hinge mechanism according to the present invention comprises: a first load plate, the first load plate including a first bottom plate, a first wheel set being installed in the first bottom plate, the first bottom plate including a first accommodating space; a second load plate, the second load plate being disposed at one side of the first load plate, the second load plate including a second bottom plate, a second wheel set being installed in the second bottom plate, the second bottom plate including a second accommodating space; a hinge mechanism, the hinge mechanism including a bridge base and two shaft sleeves pivotally connected at two sides of the bridge base, the bridge base and the two shaft sleeves together defining a wiring slot, wherein one of the shaft sleeves is fixed to the first load plate, and the other shaft sleeve is fixed to the second load plate, so that the first load plate and the second load plate are foldable toward each other, the first wheel set is received in the second accommodating space, the second wheel set is received in the first accommodating space, and the first wheel set and the second wheel set are staggered in position; and an electronic module, the electronic module including a first electronic assembly, a second electronic assembly and at least one electric wire, the first electronic assembly being assembled to the first load plate, the second electronic assembly being assembled to the second load plate, the electric wire being inserted through the wiring slot and electrically connected to the first electronic assembly and the second electronic assembly.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION OF THE INVENTION

Figure 1:
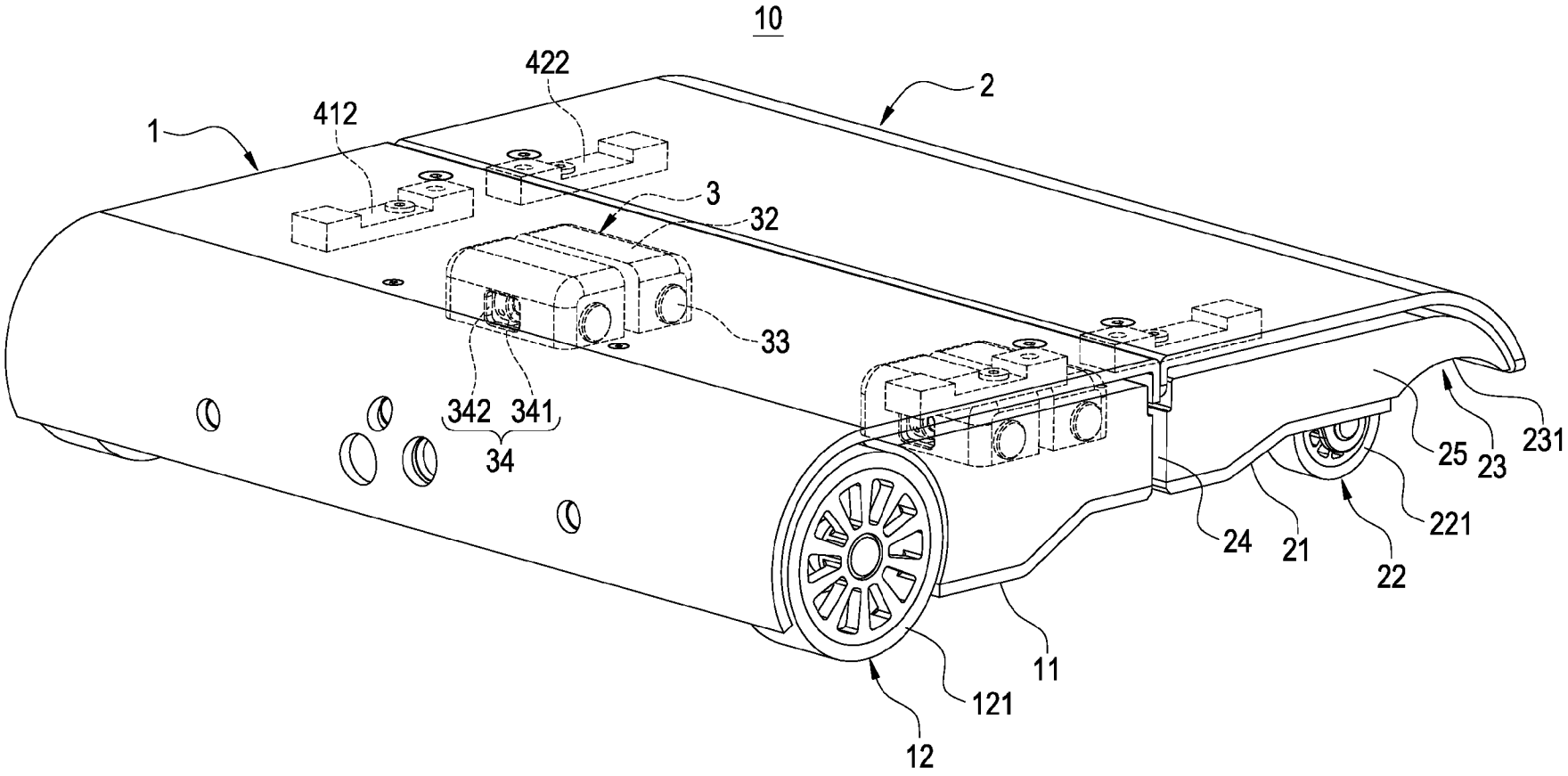
FIG. 1 is a perspective view illustrating an electric skateboard according to the present invention.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 10, the present invention provides an electric skateboard with a hinge mechanism. The electric skateboard 10 includes a first load plate 1, a second load plate 2, a hinge mechanism 3, and an electronic module 4.

Referring to FIGS. 1 to 3 and FIGS. 6 to 10, the first load plate 1 includes a first bottom plate 11, a first wheel set 12 is installed in the first bottom plate 11, the first bottom plate 11 includes a first accommodating space 13, the first wheel set 12 includes one or multiple connected wheels 121 installed in the first bottom plate 11, and the connected wheel 121 includes a linkage rod 122.

In detail, in the present embodiment, the number of the connected wheels 121 is two. The first accommodating space 13 consists of two first indentations 131 formed on the first bottom plate 11, at an inner area between the two connected wheels 121.

Referring to FIGS. 1 to 3 and FIGS. 6 to 10, the second load plate 2 is disposed at one side of first load plate 1, the second load plate 2 includes a second bottom plate 21, a second wheel set 22 is installed in the second bottom plate 21, and the second bottom plate 21 includes a second accommodating space 23. The second wheel set 22 includes one or multiple driven wheels 221 installed in the second bottom plate 21. The second load plate 2 includes two outer walls 25 disposed at two sides of the second bottom plate 21, respectively.

To be specific, in the present embodiment, the number of the driven wheels 221 is two. The second accommodating space 23 consists of two second indentations 231 formed outside the two driven wheels 221 and defined by the second bottom plate 21 of the second load plate 2 and the two outer walls 25. Each connected wheel 121 is received in each second indentation 231, and each driven wheel 221 is disposed in each first indentation 131.

Moreover, the first load plate 1 and the second load plate 2 have two adjacent surfaces 14, 24 opposite to each other. The adjacent surface 14 of the first load plate 1 has a recessed groove 141, and the adjacent surface 24 of the second load plate 2 has another recessed groove 241.

Referring to FIGS. 1 to 10, the hinge mechanism 3 includes a bridge base 31, two shaft sleeves 32 and four pivot shafts 33. The two shaft sleeves 32 are pivotally connected at two sides of the bridge base 31, one shaft sleeve 32 is fixed to the first load plate 1, and the other shaft sleeve 32 is fixed to the second load plate 2, so that the first load plate 1 and the second load plate 2 are foldable toward each other. When the first load plate 1 and the second load plate 2 are folded together, the first wheel set 12 is received in the second accommodating space 23, the second wheel set 22 is received in the first accommodating space 13, and the first wheel set 12 and the second wheel set 22 are staggered in position. The bridge base 31 and the two shaft sleeves 32 together define a wiring slot 34.

To be specific, one shaft sleeve 32 is fixed to the recessed groove 141 of the first load plate 1, and the other shaft sleeve 32 is fixed to the recessed groove 241 of the second load plate 2.

Furthermore, the bridge base 31 includes a front side 311 and a rear side 312, the front side 311 and the rear side 312 each include two first pivot holes 313, each of the shaft sleeves 32 includes a recess 321 and two side walls 322 respectively disposed at two sides of the recess 321, each of the side walls 322 includes a second pivot hole 323, the two shaft sleeves 32 are engaged with two sides of the bridge base 31 while receiving the bridge base 31 through the recess 321, each of the pivot shafts 33 is pivotally connected to each of the first pivot holes 313 and each of the second pivot holes 323, so that the two shaft sleeves 32 are pivotally connected at two sides of the bridge base 31.

Furthermore, the bridge base 31 includes a bottom side 314, a left side 315 and a right side 316, the wiring slot 34 includes a through slot 341 defined by the bottom side 314, the left side 315 and the right side 316 and also includes an opening 342 formed on each shaft sleeve 32, and the two openings 342 are disposed corresponding to two ends of the through slot 341.

Referring to FIGS. 1 to 3 and FIGS. 6, 8 and 10, the electronic module 4 includes a first electronic assembly 41, a second electronic assembly 42 and one or multiple electric wires 43. The first electronic assembly 41 is assembled to the first load plate 1, the second electronic assembly 42 is assembled to the second load plate 2, and the electric wire 43 is inserted through the wiring slot 34 and electrically connected to the first electronic assembly 41 and the second electronic assembly 42.

In detail, the first electronic assembly 41 includes a first circuit board 411 and multiple first weight sensors 412 installed inside the first load plate 1. The second electronic assembly 42 includes a second circuit board 421 and multiple second weight sensors 422 installed inside the second load plate 2. The electric wire 43 is electrically connected to the first circuit board 411 and the second electric board 421, and the electric wire 43 is inserted through the through slot 341 and the two openings 342.

The first weight sensor 412 is used to sense changes in weight on the first load plate 1, and the second weight sensor 42 is used to sense changes in weight on the second load plate 2, thereby adjusting a center of gravity or a moving direction of the electric skateboard 10.

Figure 2:
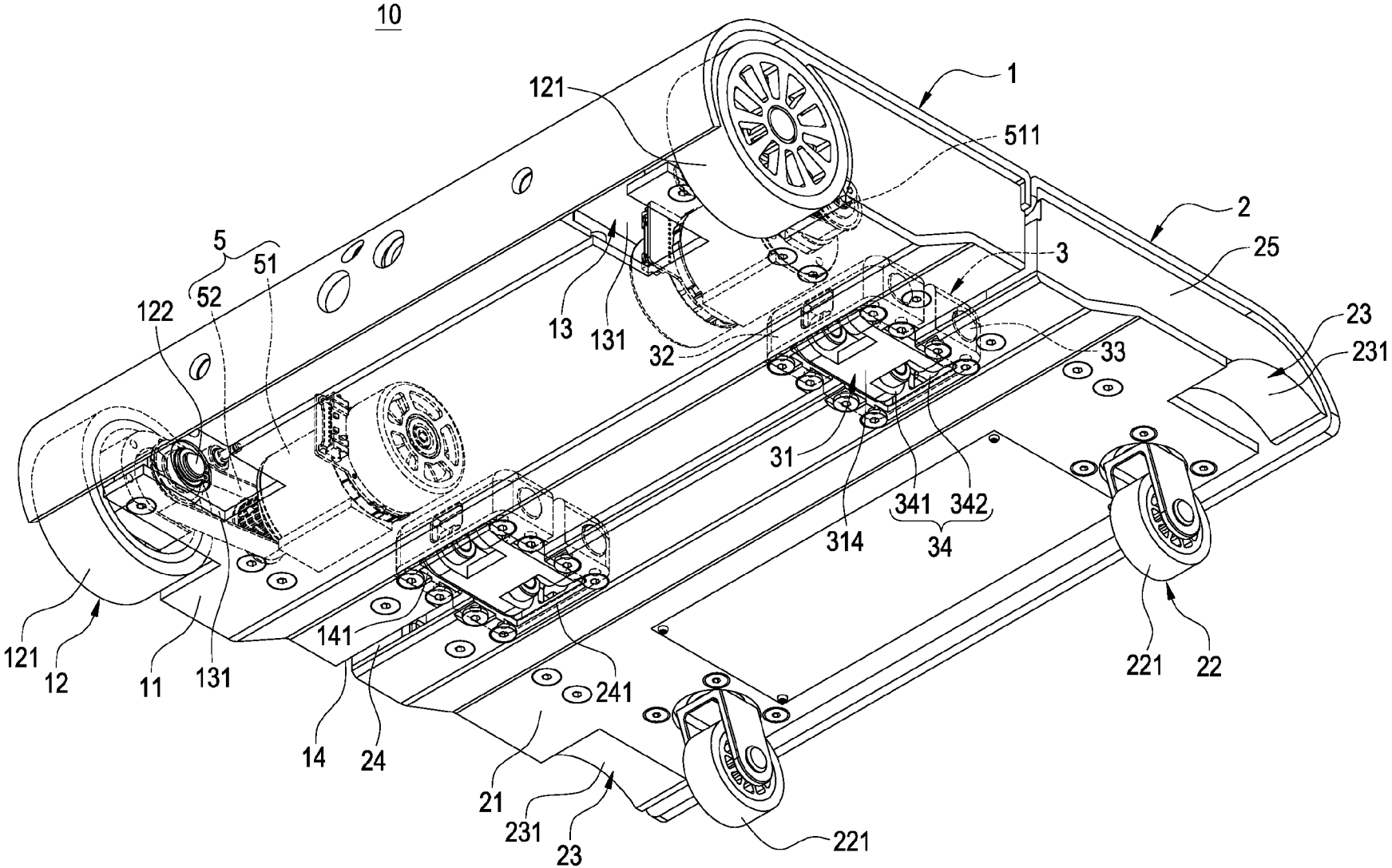
FIG. 2 is another perspective view illustrating the electric skateboard according to the present invention.
Figure 3:
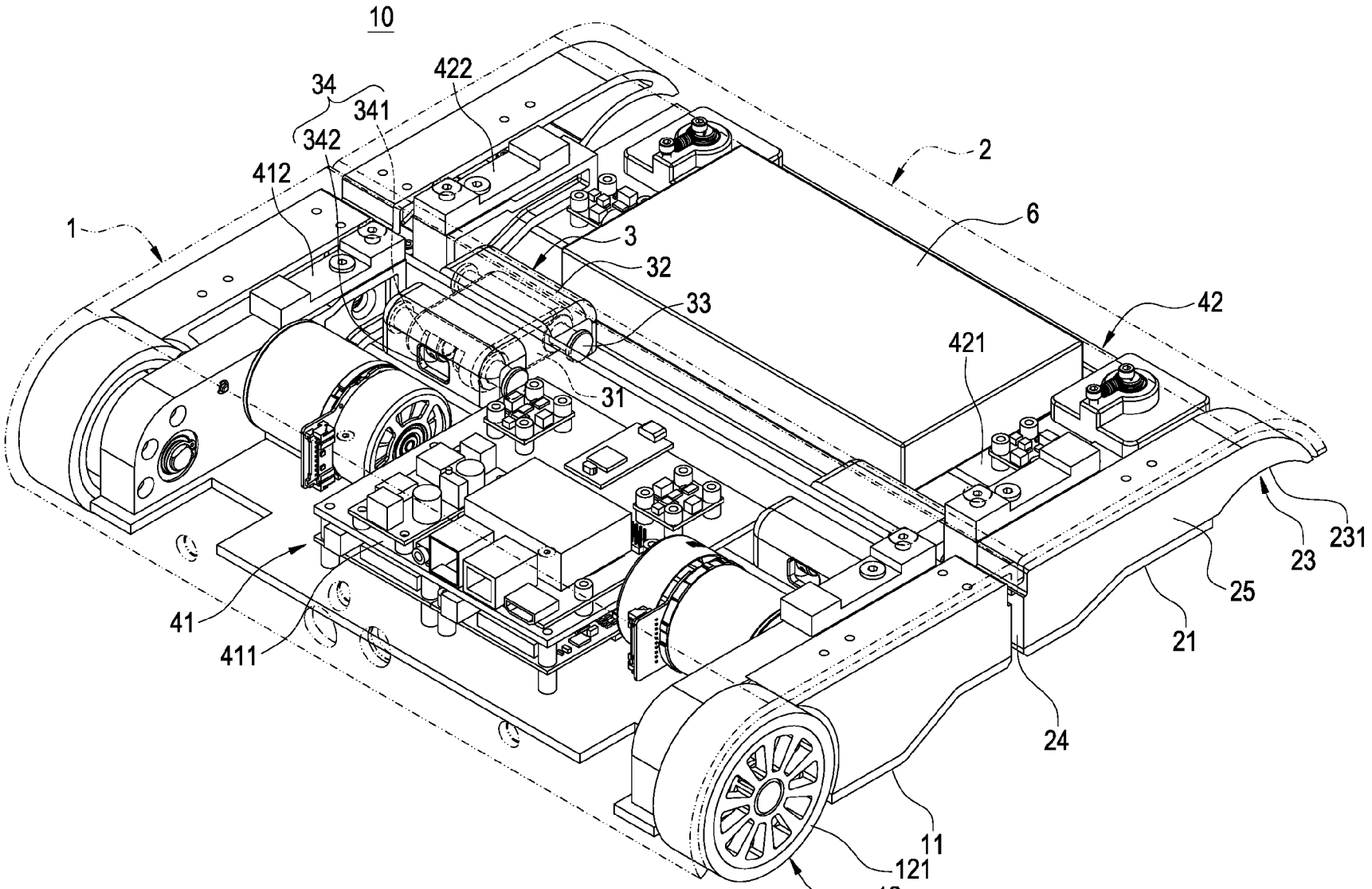
FIG. 3 is still another perspective view illustrating the electric skateboard according to the present invention.
Figure 4:
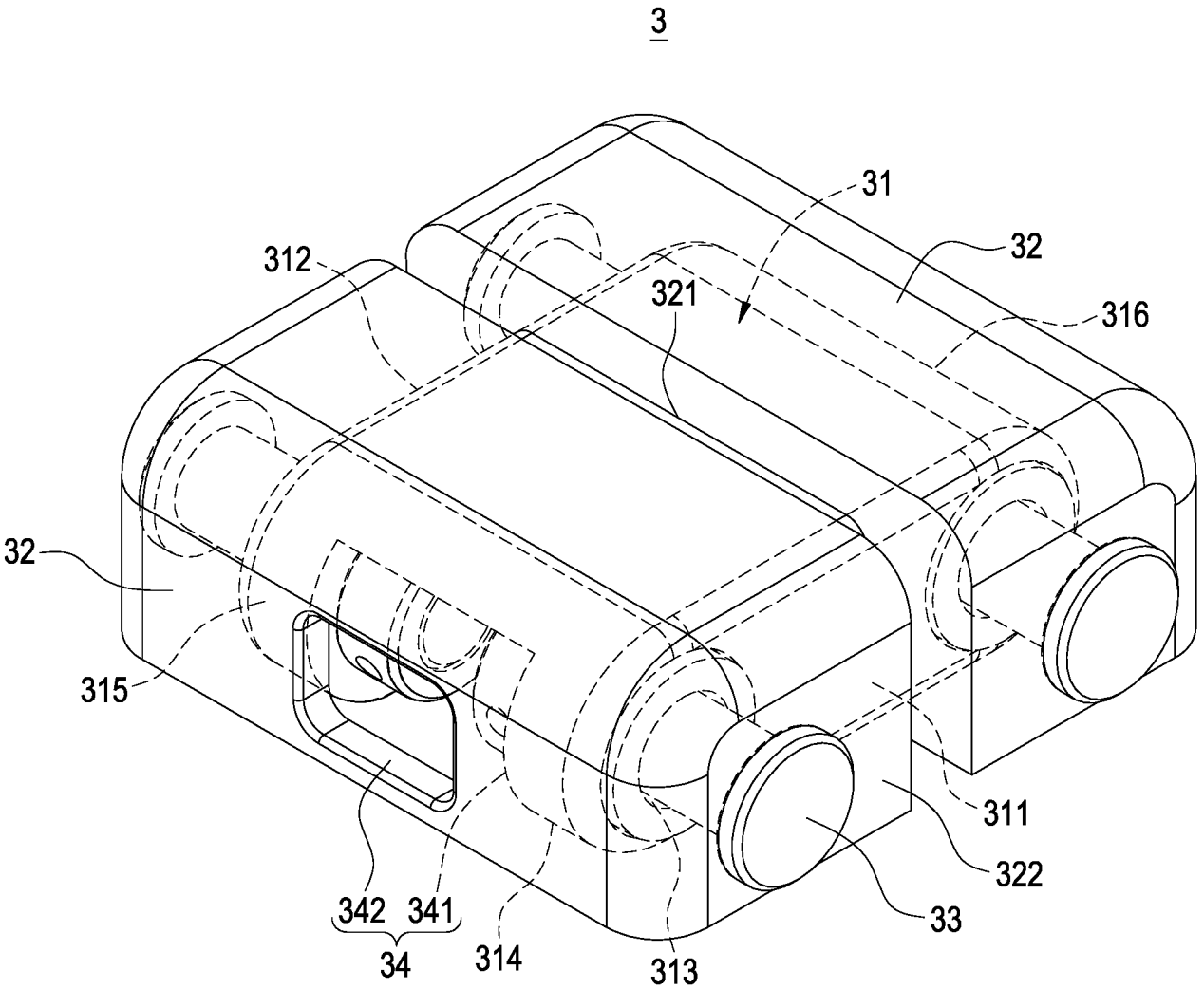
FIG. 4 is a perspective view illustrating a hinge mechanism according to the present invention.
Figure 5:
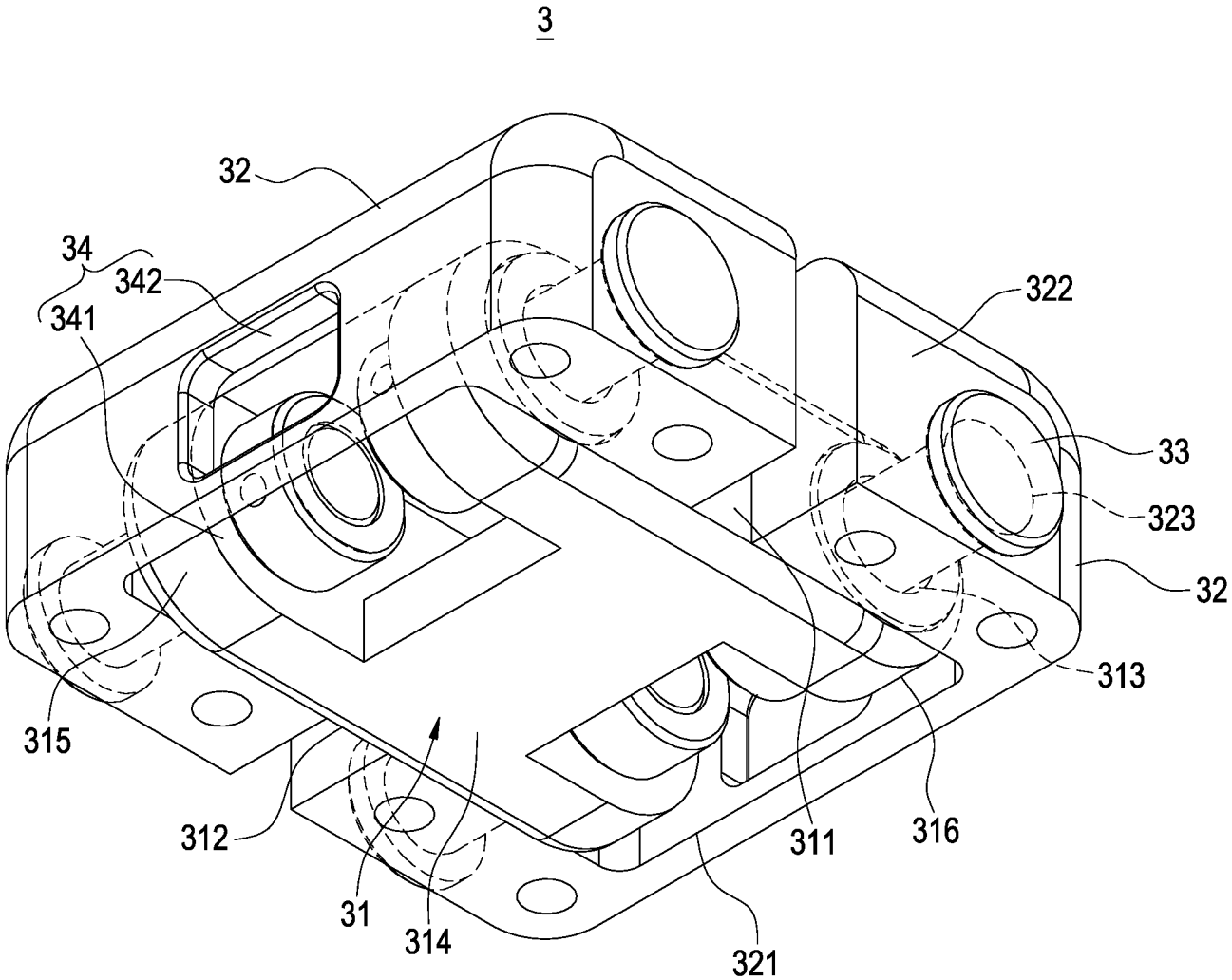
FIG. 5 is another perspective view illustrating the hinge mechanism according to the present invention.
Figure 6:
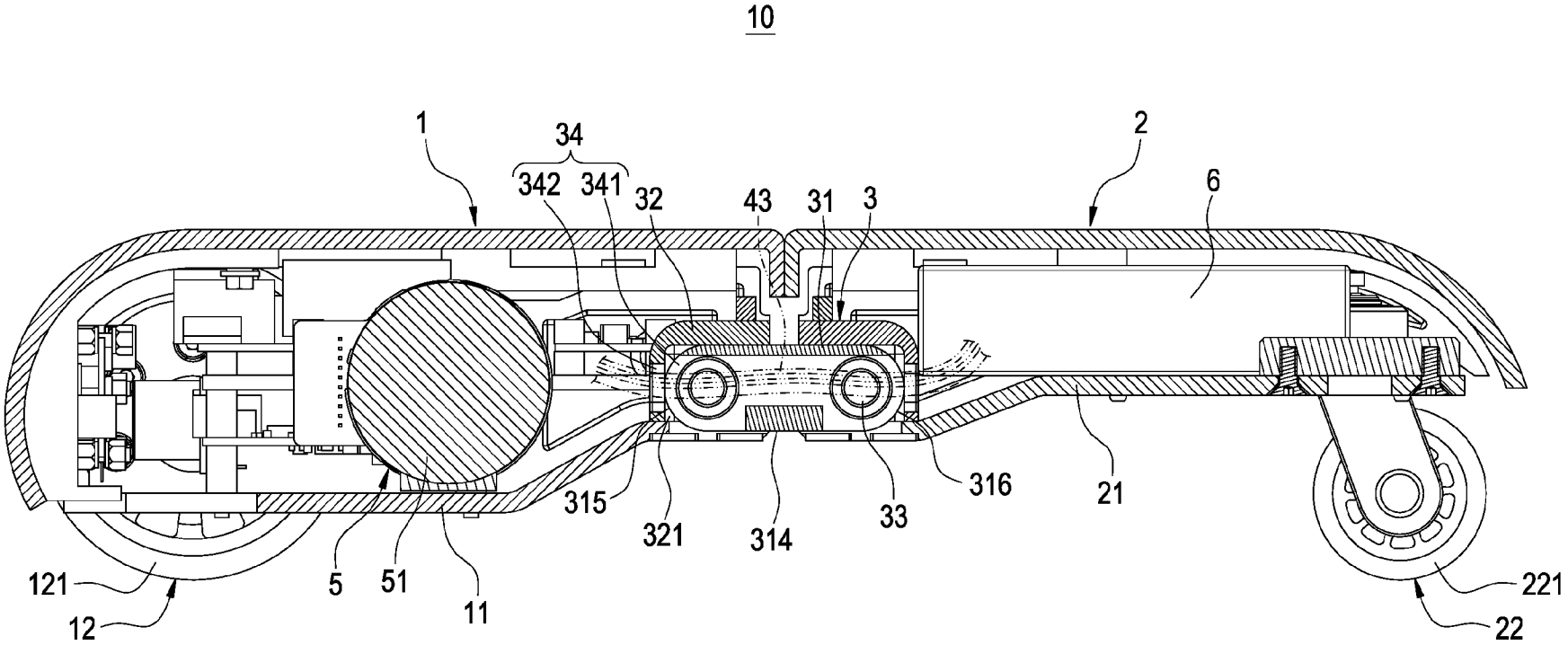
FIG. 6 is a first in-use view illustrating the electric skateboard according to the present invention.
Figure 7:
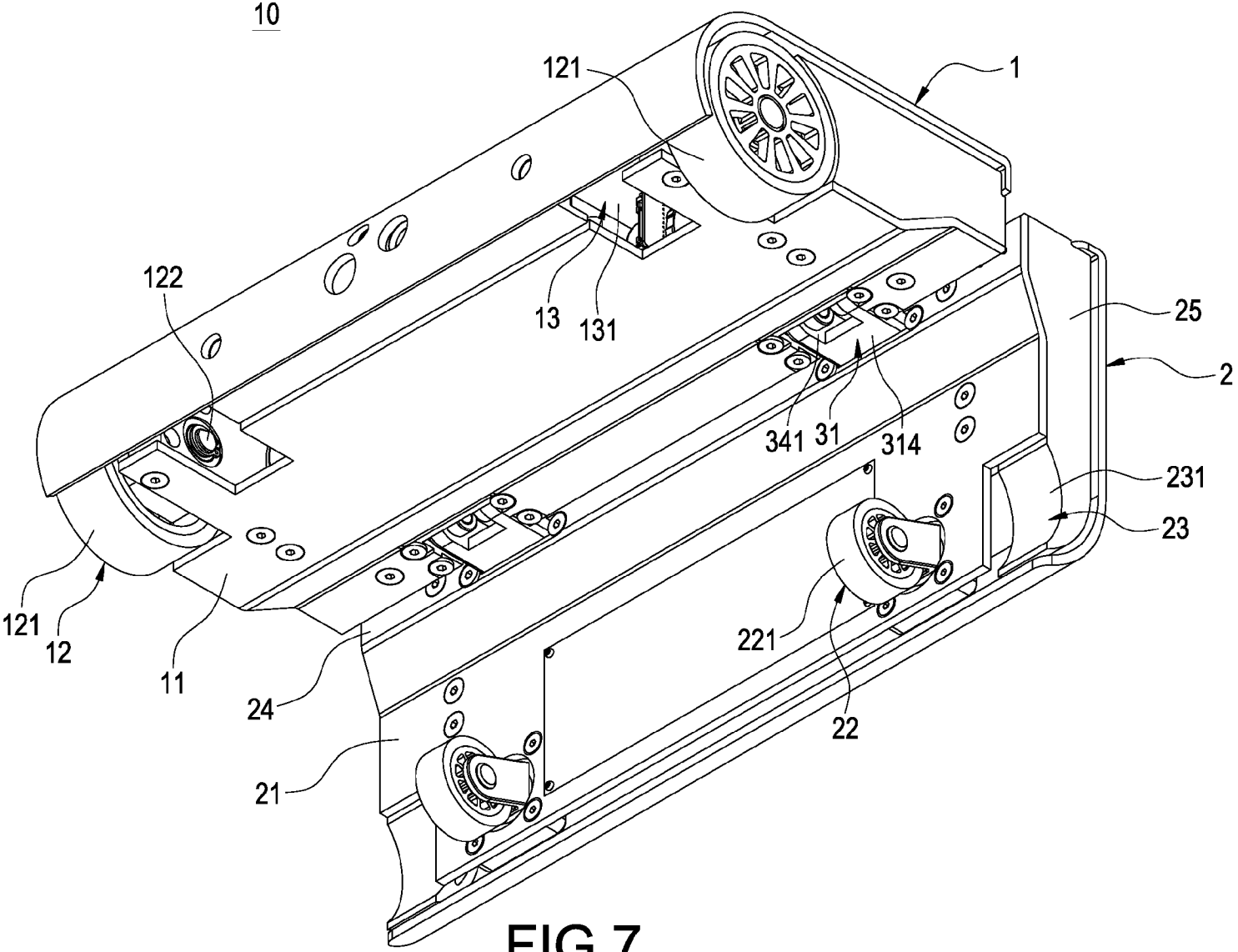
FIG. 7 is a second in-use view illustrating the electric skateboard according to the present invention.
Figure 8:
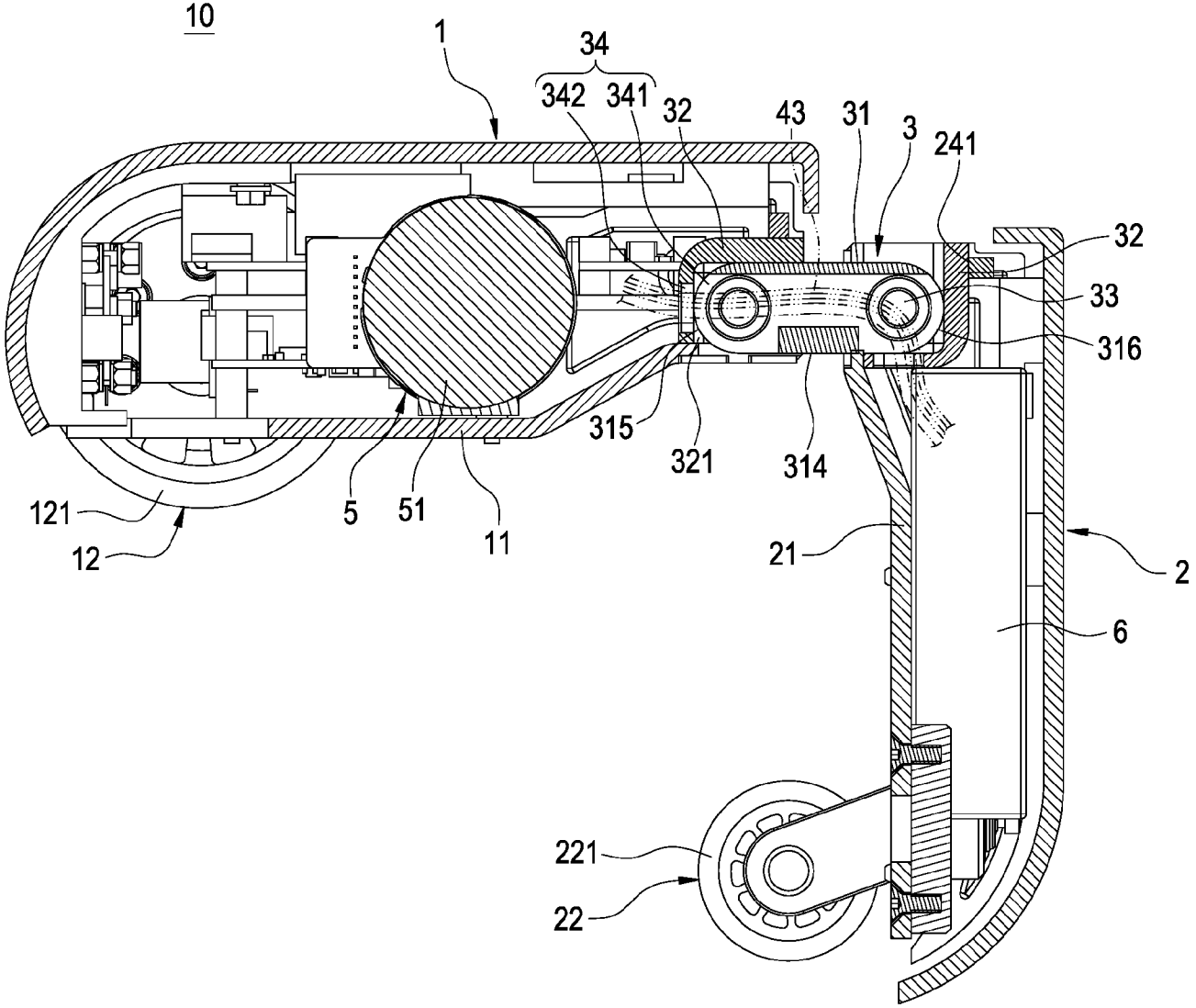
FIG. 8 is a third in-use view illustrating the electric skateboard according to the present invention.
Figure 9:
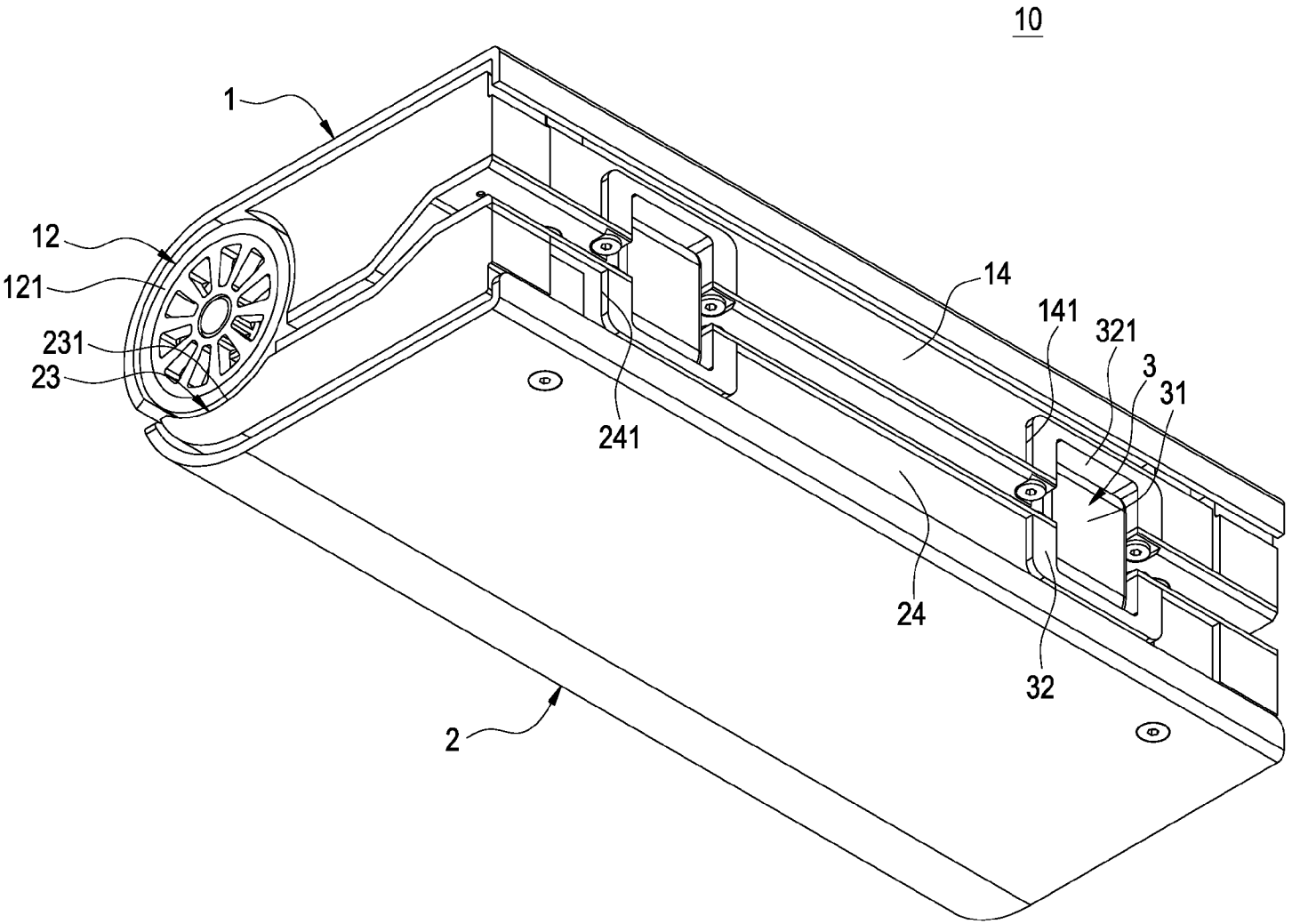
FIG. 9 is a fourth in-use view illustrating the electric skateboard according to the present invention.
Figure 10:
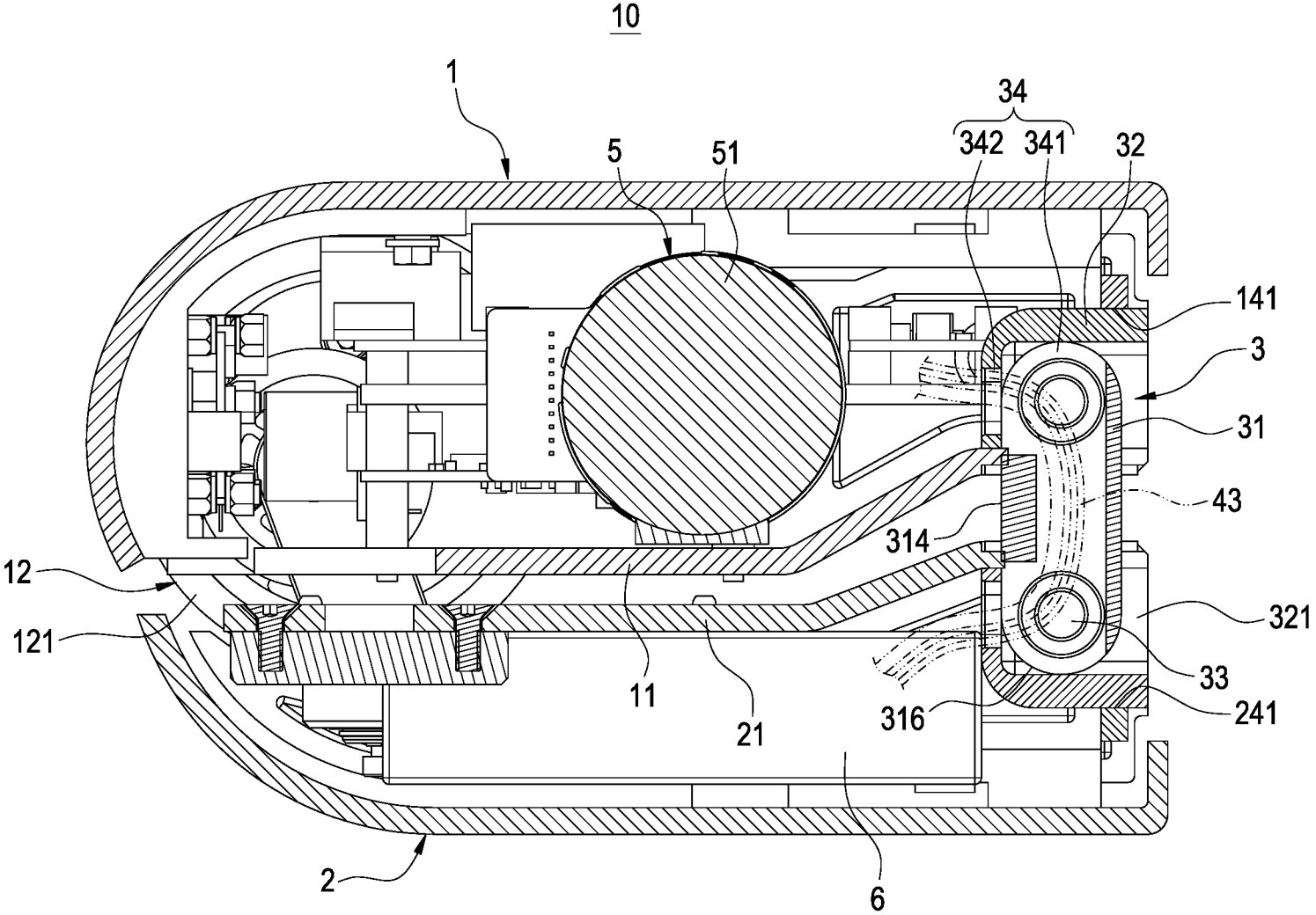
FIG. 10 is a fifth in-use view illustrating the electric skateboard according to the present invention.

Referring to FIGS. 2 and 3, the electric skateboard 10 further includes one or multiple drive assemblies 5. The drive assemblies 5 correspond in number to the number of the connected wheels 5.

In the present embodiment, the two first indentations 131 are disposed at the inner area between the two connected wheels 121, so there is not much room left at the inner area between the connected wheels 121 for installing the drive assembly 5. Hence, in the present embodiment, the drive assembly 5 includes a motor 51 and a belt 52 installed inside the first load plate 1. The motor 51 includes a drive rod 511, the belt 52 surrounds the drive rod 511 and is connected to the linkage rod 122 outside the connected wheel 121, and thereby the linkage rod 122 is driven to rotate by rotation of the drive rod 511. As a result, an adjacent portion of the inner area adjacent to the connected wheel only needs to accommodate the linkage rod 122. In addition, the motor 51 is installed inside the first load plate 1, so a thickness of the first load plate 1 is greater than a thickness of the second load plate 2.

As shown in FIG. 3, the electric skateboard 10 further includes a battery 6; the battery 6 is installed inside the second load plate 2 and is electrically connected to the second circuit board 421, and the battery 6 supplies power to the first electronic assembly 41 and the second electronic assembly 42 via the electric wire 43.

As shown in FIGS. 1 to 10, in the electric skateboard 10, the first load plate 1 includes the first bottom plate 11, the first wheel set 12 is installed in the first bottom plate 11, the first bottom plate 11 includes the first accommodating space 13, the second load plate 2 is disposed at one side of the first load plate 1, the second load plate 2 includes the second bottom plate 21, the second wheel set 22 is installed in the second bottom plate 21, the second bottom plate 21 includes the second accommodating space 23, the hinge mechanism 3 includes the bridge base 31 and two shaft sleeves 32 pivotally connected at two sides of the bridge base 31, the bridge base 31 and the two shaft sleeves 32 together define the wiring slot 34, one of the shaft sleeves 32 is fixed to the first load plate 1, the other shaft sleeve 32 is fixed to the second load plate 2, so that the first load plate 1 and the second load plate 2 are foldable toward each other; the first wheel set 12 is received in the second accommodating space 23, the second wheel set 22 is received in the first accommodating space 13, and the first wheel set 12 and the second wheel set 22 are staggered in position; the electronic module 4 includes the first electronic assembly 41, the second electronic assembly 42 and the electric wire 43, the first electronic assembly 41 is assembled to the first load plate 1, the second electronic assembly 42 is assembled to the second load plate 2, and the electric wire 43 is inserted through the wiring slot 34 and electrically connected to the first electronic assembly 41 and the second electronic assembly 42.

Please refer to FIGS. 6 to 10, which are in-use views illustrating the electric skateboard 10 according to the present invention. The hinge mechanism 3 is connected between the first load plate 1 and the second load plate 2. The two shaft sleeves 32 are rotatable with respect to the bridge base 31, so the first load plate 1 and the second load plate 2 can swing to fold up. Therefore, the electric skateboard 10 is highly adaptive to ground level variations, is collapsible for easy storage, and can be carried around conveniently.

Moreover, the first wheel set 12 and the second wheel set 22 are staggered in position. Therefore, when the first load plate 1 and the second load plate 2 are folded up, a position of the first wheel set 12 does not interfere with a position of the second wheel set 22, and the first wheel set 12 with a thickness and the second wheel set 22 with a thickness are disposed at the same level in height, and thus the electric skateboard 10 can be collapsed into a small size.

Furthermore, the electric wire 43 is inserted through the through slot 341 and the two openings 342, so that when the first load plate 1 and the second load plate 2 swing to fold up, the electric wire 43 passes through the hinge mechanism 3 smoothly and keeps electrical connection to the first electronic assembly 41 and the second electronic assembly 42, thus avoiding sharp bending, turning or twisting of the electric wire 43, and as a result, the electric wire 43 of the electric skateboard 10 is protected, and good electrical connection is maintained.

In summary, the electric skateboard with the hinge mechanism certainly can achieve anticipated objectives and solve the conventional defects. The present invention also has industrial applicability, novelty and non-obviousness, so the present invention completely complies with the requirements of patentability. Therefore, a request to patent the present invention is filed pursuant to patent law. Examination is kindly requested, and allowance of the present application is solicited to protect the rights of the inventor.

What is claimed is:

1. An electric skateboard with a hinge mechanism, comprising:

a first load plate including a first bottom plate, a first wheel set being installed in the first bottom plate, the first bottom plate including a first accommodating space;

a second load plate disposed at one side of the first load plate, the second load plate including a second bottom plate, a second wheel set being installed in the second bottom plate, the second bottom plate including a second accommodating space;

a hinge mechanism including a bridge base and two shaft sleeves pivotally connected at two sides of the bridge base, the bridge base and the two shaft sleeves together defining a wiring slot, wherein one of the shaft sleeves is fixed to the first load plate, and the other shaft sleeve is fixed to the second load plate, so that the first load plate and the second load plate are foldable toward each other, the first wheel set is received in the second accommodating space, the second wheel set is received in the first accommodating space, and the first wheel set and the second wheel set are staggered in position; and an electronic module including a first electronic assembly, a second electronic assembly and at least one electric wire, the first electronic assembly being assembled to the first load plate, the second electronic assembly being assembled to the second load plate, the electric wire being inserted through the wiring slot and electrically connected to the first electronic assembly and the second electronic assembly.

2. The electric skateboard with the hinge mechanism according to claim 1, wherein the hinge mechanism further includes four pivot shafts, the bridge base includes a front side and a rear side, the front side and the rear side each include two first pivot holes, each of the shaft sleeves includes a recess and two side walls respectively disposed at two sides of the recess, each of the side walls includes a second pivot hole, each of the two shaft sleeves is engaged with two sides of the bridge base while receiving the bridge base through the recess, and each of the pivot shafts is pivotally connected to each of the corresponding first pivot holes and each of the corresponding second pivot holes.

3. The electric skateboard with the hinge mechanism according to claim 2, wherein the bridge base includes a bottom side, a left side and a right side, the wiring slot includes a through slot defined by the bottom side, the left side and the right side and also includes an opening formed on each shaft sleeve, the two openings are disposed corresponding to two ends of the through slot, and the electric wire is inserted through the through slot and the two openings.

4. The electric skateboard with the hinge mechanism according to claim 1, wherein the first load plate and the second load plate have two adjacent surfaces opposite to each other, each adjacent surface includes a recessed groove, one of the shaft sleeves is fixed to the recessed groove of the first load plate, and the other shaft sleeve is fixed to the recessed groove of the second load plate.

5. The electric skateboard with the hinge mechanism according to claim 1, further comprising at least one drive assembly, the drive assembly including a motor and a belt installed inside the first load plate, the motor including a drive rod, the first wheel set including at least one connected wheel installed in the first bottom plate, the connected wheel including a linkage rod, the belt surrounding the drive rod and also surrounding outside the connected wheel to drive the linkage rod to rotate by rotation of the drive rod.

6. The electric skateboard with the hinge mechanism according to claim 5, wherein the number of the driven wheels is two, the second wheel set includes two driven wheels installed in the second bottom plate, the first accommodating space consists of two first indentations formed on the first bottom plate at an inner area between the two connected wheels, the second load plate includes two outer walls disposed at two sides of the second bottom plate, the second accommodating space consists of two second indentations formed outside the two driven wheels and defined by the second bottom plate of the second load plate and the two outer walls, each connected wheel is received in each second indentation, and each driven wheel is received in each first indentation.

7. The electric skateboard with the hinge mechanism according to claim 5, wherein a thickness of the first load plate is greater than a thickness of the second load plate.

8. The electric skateboard with the hinge mechanism according to claim 1, wherein the first electronic assembly includes a first circuit board and multiple first weight sensors installed inside the first load plate, the second electronic assembly includes a second circuit board and multiple second weight sensors installed inside the second load plate, and the electric wire is electrically connected to the first circuit board and the second electric board.

9. The electric skateboard with the hinge mechanism according to claim 8, further comprising a battery, the battery being installed inside the second load plate and being electrically connected to the second circuit board.

* * * * *